United States Patent [19]

Taylor

[11] Patent Number: 4,850,166

[45] Date of Patent: Jul. 25, 1989

[54] VENTILATING SYSTEM FOR ROOFING SYSTEMS

[76] Inventor: Gerald E. Taylor, 1109 Laurel La., Wilson, N.C. 27893

[21] Appl. No.: 154,208

[22] Filed: Feb. 10, 1988

[51] Int. Cl.[4] ..... E04B 7/00

[52] U.S. Cl. ..... 52/199; 52/303; 52/408; 98/42.23

[58] Field of Search ..... 52/199, 209, 303, 408; 98/29, 31, 42.01, 42.23

[56] References Cited

U.S. PATENT DOCUMENTS

| | | | |
|---|---|---|---|
| 4,489,531 | 12/1984 | Nelson | 52/199 |
| 4,538,388 | 9/1985 | Friesen | 52/199 |
| 4,651,494 | 3/1987 | Van Wagoner | 52/199 X |
| 4,736,561 | 4/1988 | Lehr et al. | 52/199 X |

FOREIGN PATENT DOCUMENTS

| | | | |
|---|---|---|---|
| 1816577 | 6/1970 | Fed. Rep. of Germany | 52/199 |
| 2412386 | 9/1974 | Fed. Rep. of Germany | 52/199 |
| 240048 | 10/1986 | German Democratic Rep. | 98/42.21 |

*Primary Examiner*—Harold Joyce
*Attorney, Agent, or Firm*—Rhodes, Coats & Bennett

[57] ABSTRACT

A venting system for allowing the escape of harmful water vapors trapped in the roof system. The system includes a roof deck forming the base of the roof system, a roofing membrane positioned over the roof deck, and a channel network positioned between said roof deck and said roofing membrane to form a plurality of venting passages below said membrane. The channel network comprises a plurality of integrally formed channel members arranged to form a grid covering the roof deck. The cross section of the channels is shaped as an inverted trough, thereby providing sufficient strength to the network's surface to support the outer roof treatment and/or to permit an installer to walk across the surface of said network without collapsing it. Roof vents pierce the roofing membrane and provide a relief passage communicating with the venting passages. Water vapor trapped beneath the roofing membrane is channeled through the venting passages to the roof vents where it evaporates into the atmosphere.

9 Claims, 2 Drawing Sheets

FIG. 1
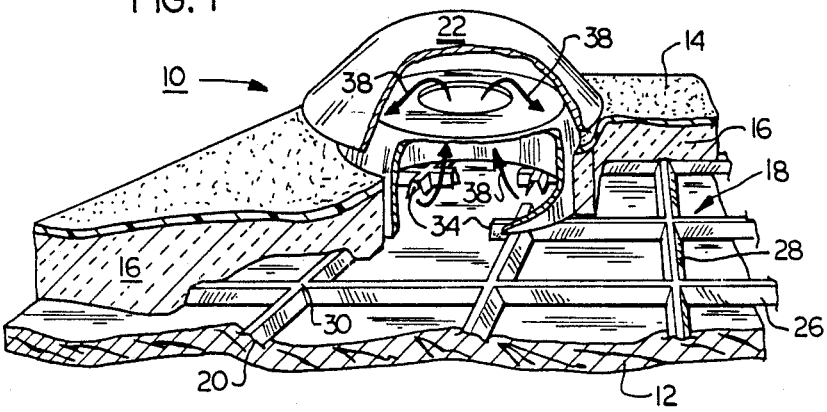
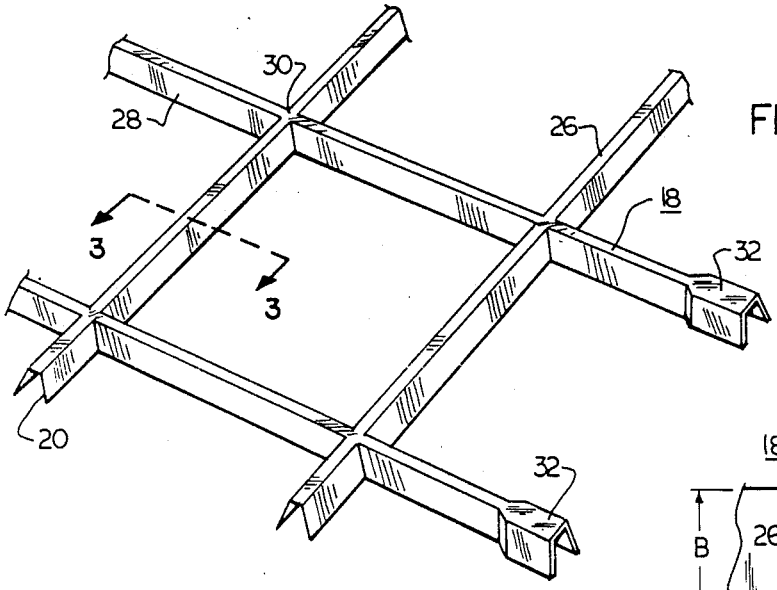
FIG. 2
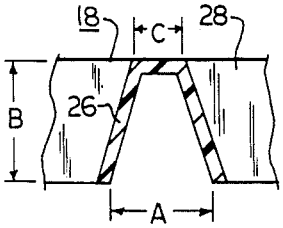
FIG. 3
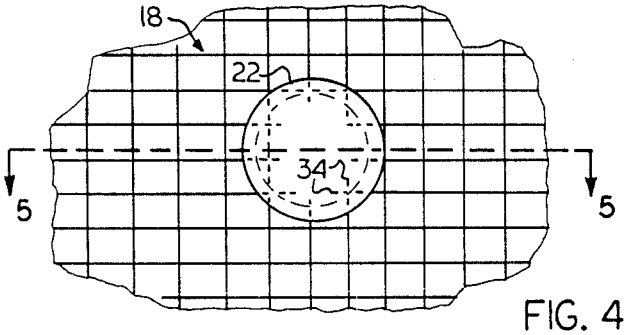
FIG. 4

FIG. 5
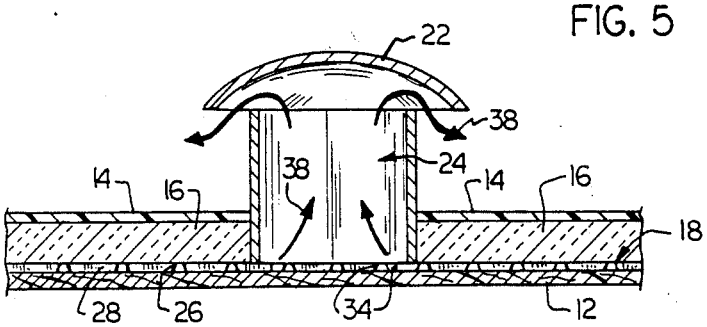
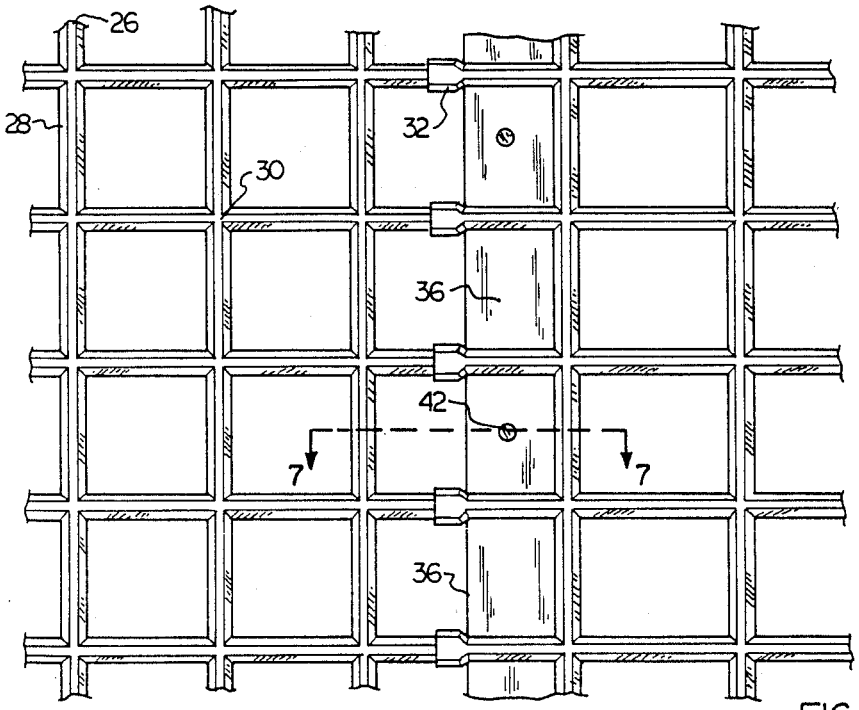
FIG. 6
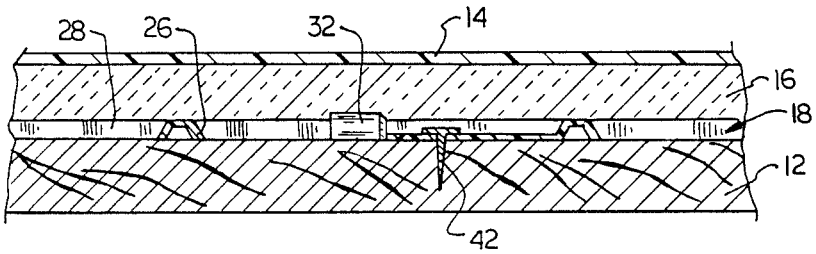
FIG. 7

VENTILATING SYSTEM FOR ROOFING SYSTEMS

BACKGROUND OF THE INVENTION (1) Field of the Invention

This invention relates in general to all roofing and in particular to a novel ventilating element in a roofing arrangement employing the same for ventilating a built-up roof.

(2) Description of the Prior Art

A conventional built-up, flat roof system is composed of at least one layer of a water impermeable roof membrane. The roof membrane is positioned over a roof deck which provides the bottom structure of the roof system over which the final outer roof treatment is placed. One such type of built-up roofing includes a number of layers of asphalt impregnated roofing felt layered on a sheathing of insulating board or sometimes directly onto the roof deck. The asphalt impregnated roofing felt provides a waterproof barrier, thereby preventing the entrance of water into the roof system. An alternative construction includes laying down a polyurethane foam layer of sufficient thickness to provide for some thermal insulation and, after the foam has had an opportunity to cure, laying down a water impermeable membrane over the top of the polyurethane foam layer.

A serious difficulty often associated with such built-up roofing is the presence of blisters forming under the waterproof membrane. Blisters are primarily caused by the expansion of air and water vapor which is trapped underneath the membrane, between adjacent layers of the asphalt impregnated roofing felt, or from the roof deck itself. The blisters eventually will rupture and allow additional water to enter the roofing. This moisture will first degrade the insulating value of the roofing and, over a period of time, cause structural failure of the roofing support system.

Because it is virtually impossible to prevent moisture from collecting in a built-up roof, attempts have been made to provide for its escape after it has become entrapped. One method of permitting the escape of air and water vapor involves using a special ventilating felt of a different composition than the usual felts. The special felt may include either a plurality of channels within it (See, for example, Long U.S. Pat. Nos. 3,387,420 to Long or 4,397,126 to Nelson) or, in the alternative, may include integrally therewith or molded therein a series of inner-connected water carrying channels disposed within the felt (See, for example, Glicksman U.S. Pat. No. 4,534,119 to Glickson). Finally, a double cuspated surface plastic film has been used to provide a multitude of venting air passages under the roof covering (see Friesen U.S. Pat. No. 4,538,388 to Friesen).

While these systems are effective in the case of roof systems using impregnated roofing felt, they are not particularly adaptable for roofing systems in which polyurethane foam is utilized or for repair of older roof systems in which only additional layers of mastic are added over the old roof. In addition, such systems add both considerable expense for materials as well as unnecessary weight to the roofing system.

It has then become desirable to develop a ventilating element for a built-up roof system that will permit harmful water vapor trapped in the roof system to escape while at the same time eliminate the prior art problems of unnecessary weight and specialized systems associated with the prior art.

SUMMARY OF THE INVENTION

The present invention solves the aforementioned problems associated with the prior art by providing a roof system for ventilating harmful water vapors. The system includes a roof deck for providing the bottom structure of the roof system, a roofing membrane positioned over the roof deck, and a network of venting channels positioned between said roof deck and said roofing membrane to form a plurality of communicating passageways below said membrane. The venting channels used with the present invention are integrally formed with one another and arranged in a grid-like pattern so that each channel intersects at least one other channel. The cross section of the channels is shaped as an inverted trough, thereby providing sufficient strength to the network surface to permit an installer to walk across the surface of said network without collapsing it. Roof vents pierce the roof membrane and provide communication between the venting passage and the atmosphere. Thus, water vapor trapped beneath the roofing membrane can be vented through the passageways of the channel network to the atmosphere.

Accordingly, one aspect of the present invention is to provide a novel roofing element having passageways therein through which harmful water vapor may pass, and which can be easily and rapidly applied to a roof deck.

Another aspect of the present invention is to provide a ventilating roofing element which is simple and economical to manufacture.

Still another aspect of the present invention is to provide a built-up roofing system which will not normally blister and allow outside moisture to enter the roofing system.

These and other aspects of the present invention will be more clearly understood after a review of the following description of a preferred embodiment of the invention, when considered with the drawings.

BRIEF DESCRIPTION OF THE DRAWINGS

FIG. 1 is a pictorial representation of a portion of the present invention in its intended environment.

FIG. 2 is an enlarged pictorial representation of the ventilating element of the present invention.

FIG. 3 is a sectional view taken on line 3—3 of FIG. 2.

FIG. 4 is a plan view of the present invention.

FIG. 5 is a sectional view taken on line 5—5 of FIG. 4.

FIG. 6 is a partial plan view of the mated edges of two adjacent courses of the ventilating element of the present invention.

FIG. 7 is a sectional view taken on line 7—7 of FIG. 6.

DESCRIPTION OF THE PREFERRED EMBODIMENT(S)

Referring now to the drawings in general and to FIG. 1 in particular, it will be understood that illustrations herein are for the purpose of describing a preferred embodiment of the invention and are not intended to limit the invention thereto.

Referring now to FIG. 1, a roof system, generally designated 10, employing the present invention is shown. The roof system includes a roof deck 12 which provides the bottom structure of the roof system 10. In a new installation, roof deck 12 would normally consist of a rigid or semi-rigid layer of fiberboard insulation ranging in thickness from one to two inches. In an old roof installation, roof deck 12 would consist of the surface of the old roof. A roofing membrane 14 is positioned over the roof deck 12 and normally consists of several layers of roofing paper (not shown). The individual layers of the roofing paper are bonded together by conventional roofing tar or asphalt to form the roofing membrane 14. There may or may not be provided crushed stone over the top surface of the roofing membrane 14. In one embodiment, additional layers of polyurethane foam 16 are added between the roofing membrane 14 and the roof deck 12. Water vapor from the inside of the building, and also water vapor leaking through the top surface of the roof membrane 14, may accumulate between the roof deck 12 and the membrane 14. This accumulated moisture is the principal cause of insulation and roof system failure.

The roof system 10 of the present invention employs a channel network 18 positioned between the roof deck 12 and the roofing membrane 14 which forms a plurality of venting passages 20 below the roofing membrane 14. A roof vent 22 pierces the roofing membrane 14 and provides a relief passage 24 communicating with the venting passages 20 and the atmosphere. Water vapor trapped beneath roofing membrane 14 is channeled through the venting passages 20 to the roofing vent 22 where it evaporates into the atmosphere.

Referring now to FIG. 2, a close-up view of the channel network 18 is illustrated. Channel network 18 includes a plurality of longitudinal channel members 26 and transverse channel members 28 arranged in a grid-like pattern so that channel members 26 intersect channel members 28. The intersections of channel members 26 and 28 form channel joints 30 which are integrally formed with the channel members 26 and 28. The channel network 18 is formed by vacuum forming a high density polyethylene (HDP) thus forming a fully integrated channel network 18. Channel network 18 is preferably formed in rolls of 48 inches by 100 foot in length. The laterally extending ends 32 of channel members 26 are formed into cup-shaped members capable of receiving a similar end from an adjacent roll.

As best seen in FIG. 3, the cross-section of channel members 26 and 28 is an inverted trough. The base of the trough is approximately half the width of the top of the trough. The wall thickness of the network is preferably between 20 and 40 mils. In the preferred embodiment, the spacing between centers of adjacent channel member is between two and five inches with three inches being preferred.

Turning to FIGS. 4 and 5, a plan view of the present invention is shown to illustrate the communication between the channel network 18 and the conventional roof vent 22. As can be seen, the diameter of roof vent 22 is sufficient to overlap a section of channel network 18 which has been removed to provide openings 34. Roof vent 22 pierces the roofing membrane 14 to provide a relief passage 24. Water vapor, channeled into the roof vent 22 by the channel network 18 is vented along vapor paths 38 through relief passage 24 to the atmosphere. The roof vent 22 should extend to a height above the surface of roof membrane 14 sufficient to prevent the entry of standing water from the roof surface into the venting passages 20 of the channel network 18.

The channel networks 18 are applied directly on the roof deck 12 adjacent one another as shown in FIG. 6 so that the ends 32 of the transverse channels 26 overlap. In the preferred embodiment, a row of panels 36 are left intact between adjacent channels 26 along one edge of channel network 18. Fasteners 38, such as nails, brads or staples, can be tacked along the edge through panels 36 to secure the channel network 18 prior to laying down the roof membrane 14.

The channel network 18 of the present invention can be either used in new installations or can be applied to existing roofs. In a new installation, roof deck 12 would normally consist of a rigid or semi-rigid layer of fiberboard insulation ranging in thickness from one to two inches. In an old roof installation, roof deck 12 would consist of the surface of the old roof. The channel networks 18 are applied directly to the roof deck 12 and fastened as described above. For most efficient operation, the channel network 18 should cover the entire area of the roof deck 12. In the preferred embodiment, the ratio of the area of the channel members 26 and 28, to the total area of the roof deck 12 is between approximately 0.25 and 0.10, with 0.15 being most preferable.

Once the channel networks 18 are installed, the roofing membrane 14 is applied over the top of the channel networks 18. In the embodiment shown herein, a layer of polyurethane foam 16 is first applied over the channel networks 18. In this embodiment, the grid-like channel networks 18 act as an anchor for the polyurethane foam layer 16 to enhance the adherence of the foam layer 16 to the roof deck 12. The roofing membrane 14 is then applied over the polyurethane foam layer 16. The roofing membrane 14 may consist of multiple layers of felt and asphalt and may include crushed stone mixed with the uppermost layer of asphalt. If the roofing membrane 14 is applied directly over the channel network 18, a thick layer of mastic, such as asphalt, should be applied over the roofing deck 12 and channel network 18 which should be of sufficient thickness to encompass the channel networks 18. The roofing membrane 14 can then be applied directly to this mastic layer.

A plurality of roof vents 22 are spaced about the surface of the roof and penetrate the roofing membrane 14 and foam layer 16 to provide a relief passage 24 which communicates with the venting passages 20. In a preferred embodiment, one vent is sufficient for every thousand square feet of roof surface. Water vapor is channeled through the venting passages 20 of the channel network 18 to the roof vent 22 where it escapes through the passage 24 into the atmosphere.

Certain modifications and improvements will occur to those skilled in the art upon reading of the foregoing description. By way of example, ventilating network 16 could be formed into other geometrical-shaped cells, such as triangles, rectangles or hexagons in addition a square-shaped cell. It should be understood that all such modifications and improvements are not described herein of the sake of conciseness and readability, but are properly within the scope of the following claims.

What is claimed is:

1. A ventilating network for use with a built up roof system to permit the escape of water vapor trapped below a waterproof membrane, said ventilating network comprising:

(a) a first set of channel members including a plurality of spaced apart channel members that extend generally parallel to one another;

(b) a second set of channel members including a plurality of spaced apart channel members that extend generally parallel to one another;

(c) wherein the channel members of one set intersect with the channel members of the other set to form and open, grid-like channel network having a plurality of open spaces between said channel members;

(d) wherein each of said channel members has an inverted, trough-shaped cross section that defines a moisture venting passage; and (e) wherein the moisture venting passages of said first and second sets of channel members communicate with one another to form said ventilating network.

2. The ventilating network according to claim 1 wherein the first and second sets of channel members are integrally formed with one another so that the intersections of said channel members of said first and second sets form channel joints that are integral with the channel members forming the joint.

3. The ventilating network according to claim 2 wherein the channel members of at least one set include first and second end portions, with the first end portions being formed into cup-shaped connecting members adapted to receive the second end portions of the channel members of an adjacent set so that two or more channel networks can be joined in side-by-side relation.

4. The channel network according to claim 3 including a plurality web-like panels extending between the first end portions of the channel members for securing the channel network to an underlying support structure.

5. The ventilating network according to claim 1 further including at least one roof vent penetrating the waterproof roof membranes and communicating with the moisture venting passages of the channel network so that moisture trapped beneath the waterproof membrane can escape through the roof vent to the atmosphere.

6. A roof system having ventilating means for venting water vapor trapped within the roofing system comprising:

(a) an underlying support structure;

(b) a substantially waterproof roof membrane positioned over the underlying support structure;

(c) a ventilating network positioned between said underlying support structure and said roof membrane including:

(1) an open, grid-like channel network comprising at least two sets of spaced-apart channel members in which the channel members of a particular set extend generally parallel to other channel members of the same set and intersect with the channel members of the other set;

(2) wherein each channel member of each set has an inverted trough-shaped configuration that defines a moisture venting passage; and (3) wherein the moisture venting passages of one set of channel members communicate with the moisture venting passages of the other set of channel members to form said ventilating network; and (d) at least one roof vent penetrating the waterproof roof membrane and communicating with the moisture venting passages of the ventilating network so that moisture trapped beneath the roof membrane can escape through the roof vent to the atmosphere.

7. The roof system according to claim 6 wherein the channel members of each set are integrally formed with one another so that the intersections of said channel members form joints that are integral with the channel members forming the joint.

8. The roof system according to claim 7 wherein the channel members of at least one set include first and second end portions, with the first end portions being formed into cup-shaped connecting members adapted to receive the second end portions of the channel members of an adjacent set so that two or more channel networks can be joined in side-by-side relation.

9. The roof system according to claim 8 further including a plurality of web-like panels extending between the first end portions of of the channel members for securing the channel network to the underlying support structure.

* * * * *